US005806733A

United States Patent [19]

Smith

[11] Patent Number: 5,806,733

[45] Date of Patent: Sep. 15, 1998

[54] SHOULDER CARRYING STRAP

[75] Inventor: Nathaniel L. Smith, Holliston, Mass.

[73] Assignee: Nepsco, Inc., Holliston, Mass.

[21] Appl. No.: 756,837

[22] Filed: Nov. 26, 1996

[51] Int. Cl.[6] ..... A45C 13/30

[52] U.S. Cl. ..... 224/264; D3/327

[58] Field of Search ..... 224/264, 642, 224/643; D3/327

[56] References Cited

U.S. PATENT DOCUMENTS

| | | | |
|---|---|---|---|
| D. 362,752 | 10/1995 | Steurer | D3/327 X |
| 2,633,573 | 4/1953 | Sanders | 224/264 X |
| 3,799,413 | 3/1974 | McBain | 224/264 |
| 4,401,246 | 8/1983 | Dickinson et al. | 224/264 X |
| 5,042,704 | 8/1991 | Izzo | 224/643 |
| 5,267,608 | 12/1993 | Torok | 224/264 X |
| 5,318,209 | 6/1994 | Rader et al. | 224/264 X |

FOREIGN PATENT DOCUMENTS

| | | | |
|---|---|---|---|
| 86924 | 2/1956 | Norway | 224/264 |

OTHER PUBLICATIONS

"BackSaver" advertisement, Smithsonian Magazine, Jul. 1997.

*Primary Examiner*—Renee S. Luebke
*Attorney, Agent, or Firm*—Wolf, Greenfield & Sacks, P.C.

[57] ABSTRACT

A shoulder carrying strap for luggage, handbags, brief cases, and the likes having a chevron-shaped pad made of a soft and flexible material and a belt extending from each end thereof and carrying fasteners at their free ends. A hinge-like fold is provided across the center of the pad to enable it to readily conform to the shoulder. The center liner of the belts are aligned with the center line of the pad.

13 Claims, 4 Drawing Sheets

SHOULDER CARRYING STRAP

BACKGROUND OF THE INVENTION

1. Field of the Invention

This invention relates to shoulder straps for carrying pocketbooks, briefcases, luggage, and similar items.

2. Description of Related Art

Conventional shoulder straps in use at this time frequently include a belt made of leather, webbing or some similar material and a pad that is attached to the belt and which serves as a cushion to reduce the discomfort that may be imposed by the weight of the load carried by the strap. The belt conventionally is straight from one end to the other and typically is between ¾ and 1 inch in width while the pad carried on the belt is also a straight piece approximately 6 to 10 inches long and 2 to 3 inches wide. Because the belt including the pad is straight from one end to the other, the strap makes no accommodation for the normal slope of the shoulder or the fact that the bag is disposed at approximately hip-height outwardly of the location on the shoulder engaged by the pad. As a result, the load imposed on the shoulder is concentrated in a very small area (essentially corresponding to one edge of the pad) resulting in a relatively high load per square inch. Furthermore, the load carried by the strap pulls the pad outwardly on the shoulder so that it slides off the shoulder as the person moves about.

An important object of the present invention is to provide an ergonomically designed shoulder carrying strap that is more comfortable than such products presently available. More particularly, the object of the present invention is to provide a shoulder carrying strap for bags, briefcase, luggage and the like which maximizes the area on the shoulder on which the load is applied and which reduces the tendency of the strap to slide off the shoulder in response to the forces imposed by the load carried by the strap.

To accomplish these and other objects, the shoulder strap of the present invention is composed of a shoulder pad having a chevron-like shape with its longitudinal side edges being V-shaped with the apexes of the edges extending in the same direction. Because the side edge of the pad, which is inboard on the shoulder defines a more acute angle than the outside edge, the width of the pad tapers from its mid-portion toward each end. Attached to the ends of the pad are separate belts of uniform width and which carry clips at their free ends for securing the strap to the bag. The centerlines of the belts are aligned with the midline of their respective halves of the pad so that the belts naturally extend downwardly and outwardly slightly to the side of the user and support the item carried by the strap slightly outwardly of the shoulder.

In the preferred embodiment, the pad is a multi-layered structure having top and bottom plies made of leather and an intermediate ply made of a foam-like material that increases the softness of the pad. The belts are also made of leather or similar material preferably two-ply, and both the belts and the pad have peripheral stitching extending about their entire margins. In addition, the pad has a pair of parallel, closely spaced rows of stitching that extend essentially between the apexes of the side edges. The stitching defines a hinge in the pad which enables the pad to more readily conform to the contours of the shoulder.

These and other objects and features of the invention will be better understood and appreciated from the following detailed description of the preferred embodiment of the invention read in connection with the accompanying drawings.

BRIEF FIGURE DESCRIPTION

DETAILED DESCRIPTION

Figure 1:
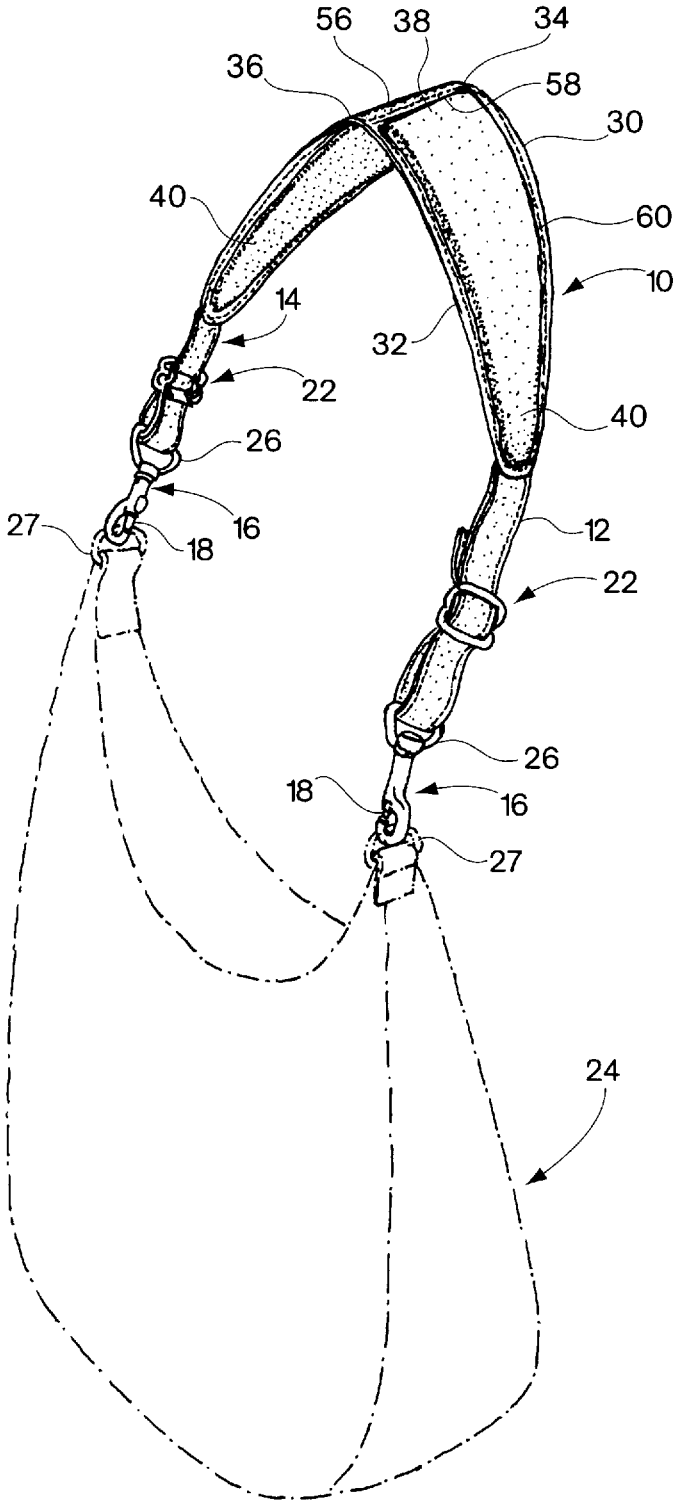
FIG. 1 is a perspective view of a shoulder carrying strap embodying the present invention and suggesting lines a typical bag that may be carried by it.

The shoulder carrying strap of this invention shown in the drawing includes a shoulder pad 10 connected to belts 12 and 14 at its ends, and the belts in turn carry fasteners 16 at their free ends. The fasteners preferably are swivel clips having retractable fingers 18 as are well-known and used extensively for such purposes as joining straps to luggage. The fasteners 16 are secured to the belts 12 and 14 by D-rings 26 through which the belt ends are threaded. The length of the belts may be adjusted by sliders 22 that are also well-known and widely used. In FIG. 1, the clips 16 are shown secured to bag 24 by means of D-rings 27 attached to the bag.

Figure 6:
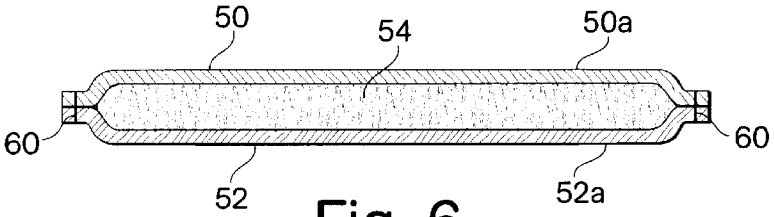
FIG. 6 is a cross-sectional view of the shoulder pad of the strap taken along the section line 6—6 of FIG. 4.

The construction of the pad 10 is shown in detail in FIGS. 2, 3, 4, and 6. It is generally chevron-shaped having longitudinally extending side edges 30 and 32, both of which are V-shaped with their apexes 34 and 36 pointing in the same direction. The angle defined by the side edge 30 is smaller than the angle defined by the side edge 32 and consequently the side edges converge from the mid-portion 38 of the pad in the direction of the ends 40. The angle A and B defined by the side edges 30 and 32 are approximately 62° and 67° degrees respectively. As shown in FIG. 6, the pad 10 is a three-ply assembly having top and bottom layers 50 and 52, made of a strong and yet flexible material such as leather. The leather layers 50 and 52 sandwich a foam layer 54 made of either a natural or synthetic sponge-like material which adds softness to the pad.

The overall dimensions of the pad may vary, but the dimensions set forth below are suitable for general applications. The pad 10 specifically designed to carry a large pocket book 24 suggested in FIG. 1 or a briefcase, computer case or luggage may be approximately 12 inches long measured in a straight line from end to end, approximately 2¾ inches wide at the mid-portion measured between the apexes of the two side edges, and approximately 1½ inch wide at the ends 40. The total thickness of the pad measured inwardly of the edges is approximately ⅜ of an inch.

Figure 2:
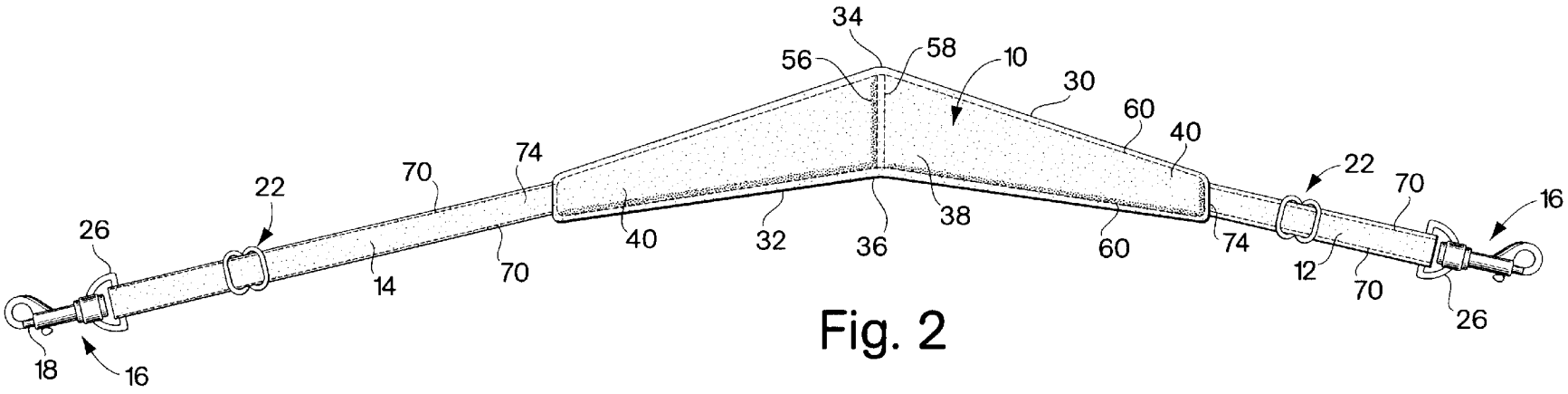
FIGS. 2 and 3 are top and bottom plan views of the strap disposed flat in a single plane.
Figure 3:
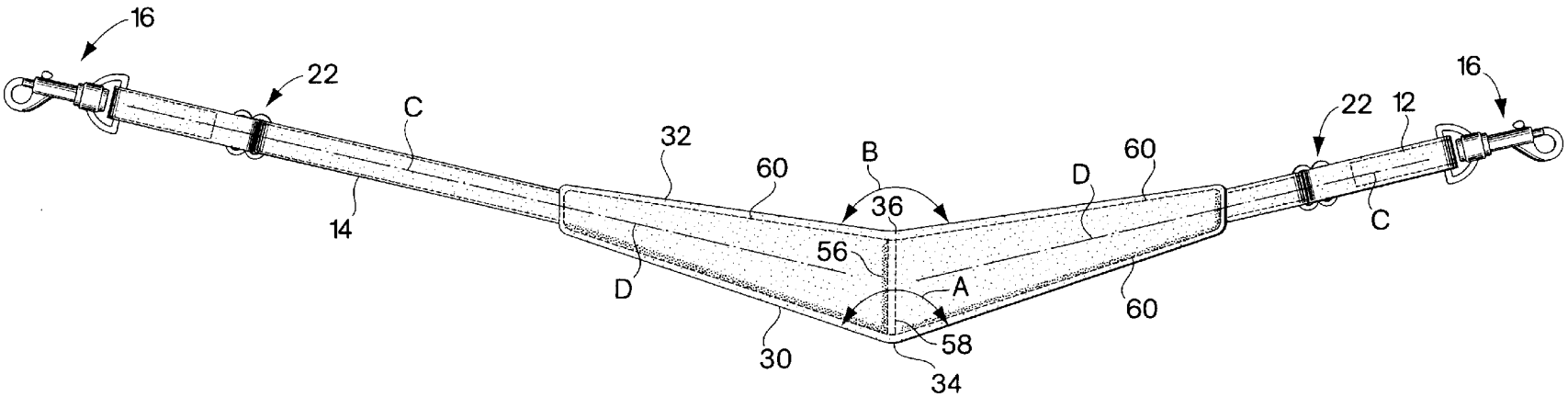
Figure 4:
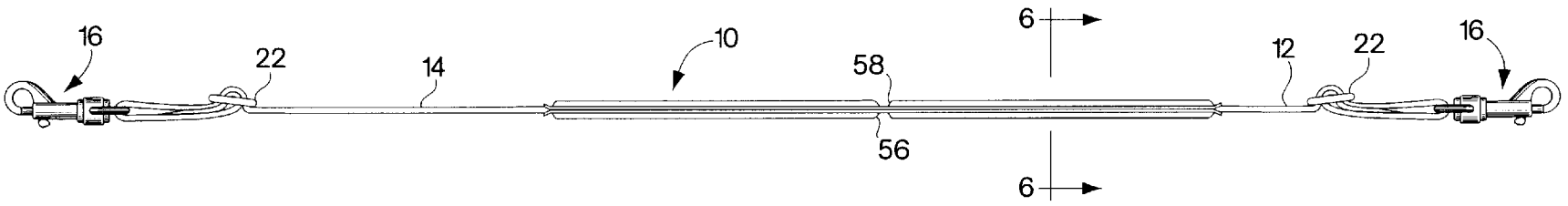
FIG. 4 is a side elevation view of the shoulder strap of the present invention.

As is evident in FIGS. 2, 3, and 6, a continuous peripheral line of stitching 60 extends about all of the sides of the pad 10 and is disposed inwardly of the edge approximately ⅛ inch. In addition, two closely spaced parallel rows of stitching 56 and 58 extend across the mid-portion 38 of the pad between the apexes 34 and 36. As shown in FIG. 4, the parallel rows of stitching 56 and 58 compress the mid-portion 38 of the pad so as to form a hinge or fold line that enables the pad to readily bend and conform to the shoulder. The middle layer 54 may be made up of one continuous piece of foam compressed at the mid-portion 38 by the stitching 56 and 58, or alternatively two separate foam pieces may be used, one on each half of the pad on opposite sides of the stitching 56 and 58. The three layers preferably are also glued together.

In its preferred form, both the upper and lower layers 50 and 52 are made of leather with their finished sides facing upwardly. The rough side 52*a* of the leather layer 52 is exposed on the bottom of the pad and is intended to rest on the shoulder and resist slipping of the pad off the shoulder. The finished side 50*a* of the layer 50 is exposed when the pad rests on the shoulder.

The straps 12 and 14 are essentially identical to one another and preferably are composed of two leather strips 67 and 69 approximately one inch wide, glued together back to back and also stitched together as suggested at 70 about their periphery approximately ⅛ inch in from the edges. The free end of each belt is skived as shown at 72 to reduce its thickness so that it merges smoothly with the body of the belt when secured to the clip 16.

Figure 8:
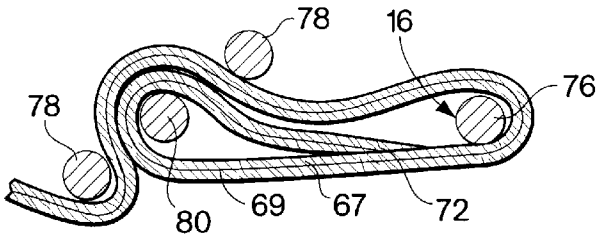
FIG. 8 is an enlarged fragmentary cross-sectional view of the free end of one belt showing the manner in which it is connected to the slide for adjusting the belt length as well as the fastener for securing the belt to the bag to be carried by the strap.
Figure 7:
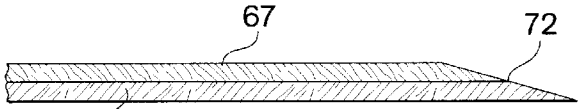
FIG. 7 is an enlarged cross-sectional view of the free-end of one of the belts.
Figure 5:
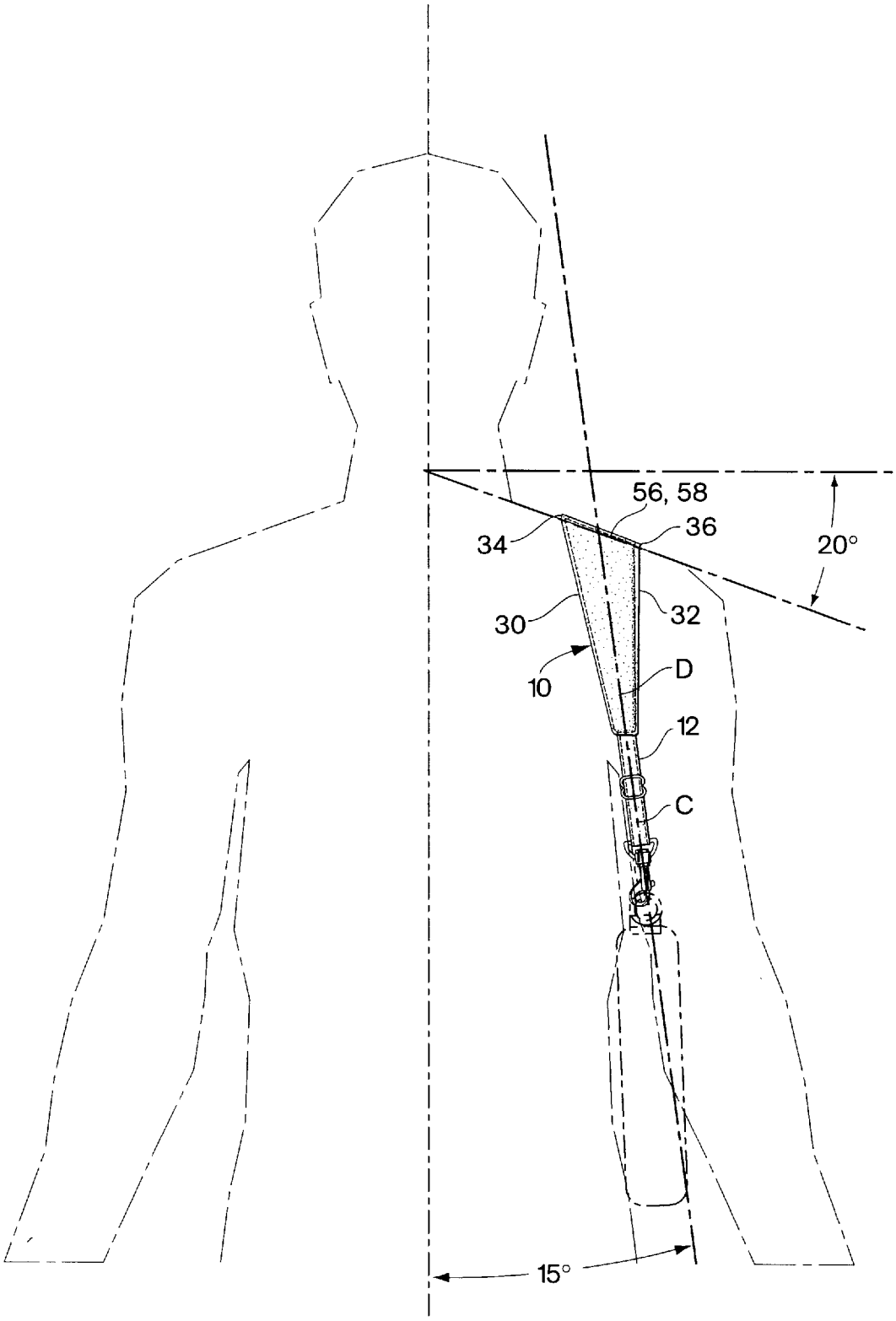
FIG. 5 is a diagrammatic front view of the strap shown in its operative position carrying a briefcase like load on the shoulder of a person, a briefcase being suggested in broken lines.

One end 74 of each belt is seen into the end of portion 40 of the pad by means of the peripheral stitching 70 described above. The other end of each belt loops through the straight side 76 of the D-ring 26 forming part of the swivel clip 16. Each belt is also threaded below the outer side bars 78 and over the center bar 80 of its slider 22. The free end of each belt is then brought back to the slider 22 about the middle bar 80 and is glued and stitched to itself as illustrated in FIG. 8. The skived raw edge of the belt reduces the thickness of the assembly as is evident in FIGS. 7 and 8.

As shown in FIG. 3, the center line C of each belt 12 and 14 is coincident with the center line D of its respective half of the pad rather than being aligned with either of the side edges 30 and 32. This orientation of the belts contributes to the improved performance of the shoulder strap when in use, as described below.

The strap is designed to distribute the carrying load more efficiently than the conventional strap described in the introduction. As the strap is place over the wearer's shoulder, the strap conforms to the natural angle of the shoulder (20° from the horizontal) approximately so that the load is distributed across the entire width of the strap. The hinge across the center of the pad 10 defined by the stitching 56 and 58 along with the chevron-shape allows the strap to lie flat on the shoulder. Additionally, the strap does not hang straight down, but at an angle of approximately 15° from the vertical, the normal angle from the support point at the shoulder to the attachment point on the load. The result is that under actual wearing conditions, more of the area of the strap is flat against the wearer's body, capable of supporting the weight of the load. The more area supporting the load, the more distributed the load. By contrast, a conventional strap does not take into consideration the natural shape and angles of the human form. Its tendency is to hang directly down from across a flat surface. The strap, if not compliant, will be approximately 35° askew to the surface of the shoulder, and the entire load will be supported by the edge of the strap over a very limited area on the top of the shoulder. Since the strap of the present invention follows the contours of the body, the entire area of the load is distributed over the pad 10 (in the example described approximately 32 sq. inches). In contrast, the generic strap does not lay flat, but is slightly twisted both at the shoulder area and along the chest and back area. The effective area of the conventional strap is confined to only about a ½ inch width over the pad length.

From the foregoing detailed description, those skilled in the art will appreciate that numerous modifications may be made of the present invention without departing from its spirit. Therefore, it is not intended that the breadth of the invention be limited to the specific embodiment illustrated and described. Rather its scope is to be determined by the appended claims and their equivalents.

I claim:

1. A shoulder strap for carrying various strap supported loads comprising a V-shaped shoulder pad made of a soft and flexible material having a mid-portion at the apex of the V-shape and end portions remote from the apex, said pad also having longitudinally extending upper and lower side edges that converge toward each other from the mid-portion to the end portions thereof and having a midline equidistant from the side edges, a hinge fold extending across the pad at its mid-portion, and a pair of belts, one secured to each end portion of the pad and extending away from the pad and aligned with the midline of the pad for securing the strap to a load to be carried by the strap.

2. A shoulder strap as defined in claim 1 wherein the belts are of substantially uniform width and each has one end secured to an end portion of the pad and carrying a fastener at its other end for engaging the load to be carried.

3. A shoulder strap as defined in claim 2 wherein the fasteners are swivel clips.

4. A shoulder strap as defined in claim 2 wherein the ends of the belts attached to the pad are stitched to the end portions thereof.

5. A shoulder strap as defined in claim 1 wherein the upper and lower side edges of the pad are both V-shaped and the angle of the upper side edge defined by the portions of that edge extending from its apex to the end portions is smaller than the corresponding angle in the lower edge of the pad.

6. A shoulder strap as defined in claim 1 wherein the pad includes upper and lower layers of a leather material and an intermediate layer of a foam material, said layers being adhesively joined in face to face relationship.

7. A shoulder strap as defined in claim 6 wherein the upper and lower layers are stitched together about their edges.

8. A shoulder strap as defined in claim 7 wherein the ends of the belts attached to the pad are stitched to the end portions thereof.

9. A shoulder strap as defined in claim 1 wherein the pad includes upper and lower layers, said layers being stitched together along their edges in face to face relationship.

10. A shoulder strap as defined in claim 1 wherein the hinge fold is defined by at least one row of stitching extending across the mid-portion.

11. A shoulder strap as defined in claim 1 wherein the upper and lower side edges are each V-shaped with the V's of both edges facing in the same direction.

12. A shoulder strap for carrying various strap supported loads comprising a V-shaped shoulder pad made of a soft and flexible material having a mid-portion at the apex of the V-shape and end portions remote from the apex, said pad also having longitudinally extending upper and lower side edges that converge toward each other from the mid-portion to the end portions thereof and having a midline equidistant from the side edges, and a pair of belts, one secured to each end portion of the pad and extending away from the pad and aligned with the midline of the pad for securing the strap to a load to be carried by the strap.

13. A shoulder strap as defined in claim 12 wherein the belts are of substantially uniform width and each has one end secured to an end portion of the pad and carrying a fastener at its other end for engaging the load to be carried.

* * * * *